United States Patent [19]

Boogers et al.

[11] 4,223,684

[45] Sep. 23, 1980

[54] METHOD AND DEVICE FOR CUTTING A TOBACCO LEAF INTO PORTIONS SUITABLE FOR USE AS BINDERS OR WRAPPERS

[75] Inventors: Wilhelmus P. L. Boogers, Eindhoven; Albertus C. H. Van Liempd, St. Oedenrode, both of Netherlands

[73] Assignee: B.V. Arenco P.M.B., Best, Netherlands

[21] Appl. No.: 952,319

[22] Filed: Oct. 17, 1978

[30] Foreign Application Priority Data

Nov. 15, 1977 [NL] Netherlands ..... 7712589

[51] Int. Cl.[3] ..... A24B 7/00

[52] U.S. Cl. ..... 131/105; 83/71; 83/371; 83/510; 83/564; 53/118; 53/430

[58] Field of Search ..... 83/510–512, 83/50, 55, 71, 371, 564; 131/105, 23 R, 20 R; 53/118, 430

[56] References Cited

U.S. PATENT DOCUMENTS

| | | | |
|---|---|---|---|
| 13,296 | 7/1855 | Arthur | 83/532 X |
| Re. 14,601 | 2/1919 | Rosenthal | 83/510 X |
| 487,840 | 12/1892 | Kaufman | 83/510 |
| 1,041,341 | 10/1912 | Peterson | 83/510 |
| 2,217,060 | 10/1940 | Korsen | 83/510 X |
| 3,490,320 | 1/1970 | Valembois et al. | 83/71 X |
| 3,826,170 | 7/1974 | Jones et al. | 83/925 CC |
| 3,931,501 | 1/1976 | Barr et al. | 83/371 X |

*Primary Examiner*—J. M. Meister

*Attorney, Agent, or Firm*—John P. Snyder

[57] ABSTRACT

A method and a device for cutting up a tobacco leaf into portions suitable for use as binders or wrappers, in which cutting members are employed, which have a cutting edge matching uninterruptedly the desired circumference of a wrapper or binder wherein a plurality of cutting members are arranged on a carrier in an arbitrary configuration, the tobacco leaf is spread across said number of cutting members, the tobacco leaf is divided up by the corresponding number of cutting edges and the leaf portions located within the cutting edges are removed from the cutting members, whereby the tobacco leaf is completely divided up in one run into usable and waste portions which considerably enhance the production of binders and wrappers.

8 Claims, 2 Drawing Figures

METHOD AND DEVICE FOR CUTTING A TOBACCO LEAF INTO PORTIONS SUITABLE FOR USE AS BINDERS OR WRAPPERS

The invention relates to a method and a device for cutting up a tobacco leaf into portions suitable for use as binders or wrappers, in which cutting members are employed, which have a cutting edge matching uninterruptedly the desired circumference of a wrapper or binder.

Hitherto it has been common practice to spread tobacco leaves as a whole or halves of them across a cutting bed, which occupies a fixed position in a machine, particularly a wrapping machine, said cutting bed usually having only one or, at the most, two cutting members for cutting out one or, at the most, two tobacco leaf portions.

The invention has for its object to provide a completely new method in which a much greater number of cutting members are employed.

The method according to the invention is distinguished in that a plurality of cutting members are arranged on a carrier in an arbitrary configuration, the tobacco leaf is spread across said number of cutting members, the tobacco leaf is divided up by the corresponding number of cutting edges and the leaf portions located within the cutting edges are removed from the cutting members.

The advantage obtained, in accordance with the invention, by a number of cutting members freely displaceable across a carrier resides in that not only an optimum cutting method in accordance with the circumference of the tobacco leaf can be ensured but also damage of the tobacco leaf can be avoided. Moreover, the tobacco leaf is completely divided up in one run into usable and waste portions, which considerably enhances the production of binders and wrappers.

According to a further aspect of the method the number of cutting members are placed out of a fixed arrangement in a stock station in the desired configuration on the carrier and after the removal of the leaf portions they are returned to the stock station in the same fixed arrangement. In this manner a comparatively simple mechanisation of the arrangement of the cutting members can be obtained and according to a further aspect of the invention this mechanisation can be controlled by a computing instrument.

The invention proposes to dispose the cutting members by means of a conveyor in accordance with a co-ordinate system on the carrier, which co-ordinate system may be stored in the computer memory.

Such an embodiment comprising a computer is eminently suitable for pre-scanning the tobacco leaf to be worked. Scanning is performed with the aid of an electro-magnetic beam which generates signals representative of the contour and any damaged spots of the leaf, said signals being processed by the computer into signals controlling the conveyor.

The device according to the invention is distinguished in that the carrier is constructed in the form of a suction box, the carrying surface of which exhibits a uniform pattern of uninterrupted apertures, whilst each cutting member has a perforated wall inside the cutting edge freely communicating with the carrier. Thus the tobacco leaf can be stuck by suction to the cutting members in a simple manner.

Moreover, each cutting member may comprise a permanent magnet and the surface of the carrier may be made of magnetisable material. In this way the cutting member is firmly retained on the carrier so that the tobacco leaf can be cut with the aid of the conventional cutting rollers without a risk of displacement of the cutting member relative to the carrier.

Further features and advantages will become apparent from the following description with reference to a drawing of a potential embodiment of a device for carrying out the method.

Figure 1:
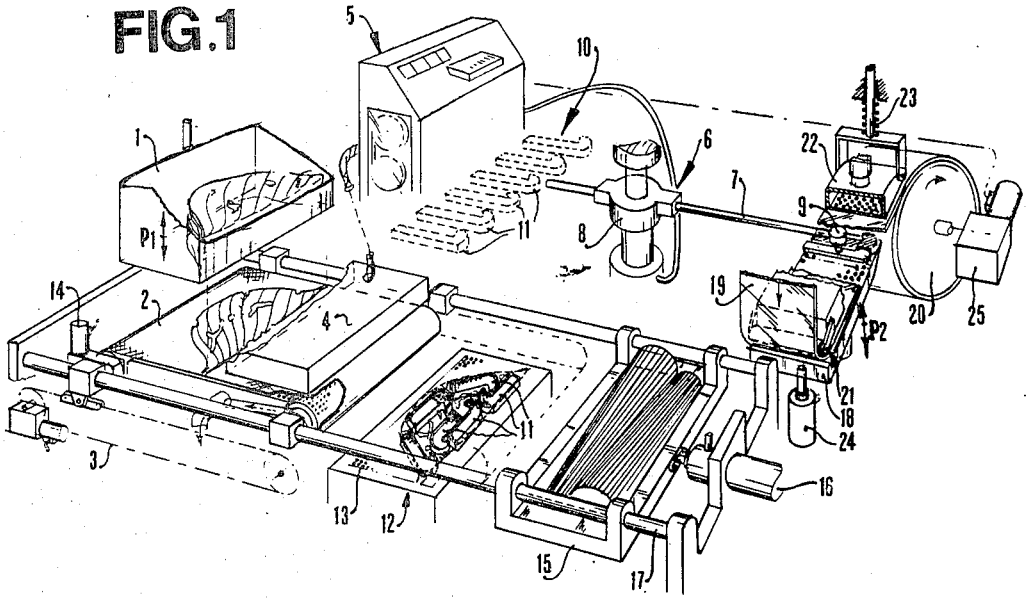
FIG. 1 is a perspective, schematic plan view of a potential device.

Referring to FIG. 1, reference numeral 1 designates a stock container for the tobacco leaves to be worked up. The tobacco leaves are stemmed so that leaf halves are stacked in the container 1. The container 1 is moved up and down in the direction of the arrow P1, for depositing every lowermost tobacco leaf on a subjacent conveyor belt, which is at the same time a suction belt so that the tobacco leaf is retained on the upper run of the belt and subsequently passed by means of a driving mechanism 3 past beneath a scanning station 4. Scanning in the station 4 may be performed in any suitable manner, preferably by means of electro-magnetic beams, the generated signals being applied to a computer 5.

Figure 2:
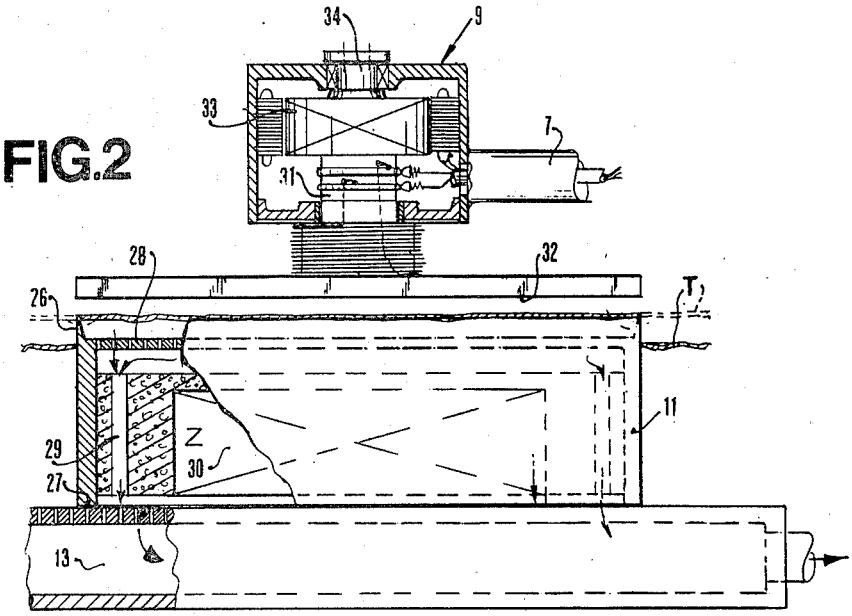
FIG. 2 is a sectional view and partly an elevational view of a preferred embodiment of a cutting member employed in the method in accordance with the invention.

The computer 5 processes these incoming signals and can assess, as the case may be with the aid of a memory, the optimum cutting pattern for the leaf to be worked, taking into account the circumference of the leaf and the damaged spots thereof, if any. The computer 5 controls a conveying mechanism 6 formed by an arm 7, which is adapted to turn about a pivot 8, the free end of the arm 7 having a pick-up head 9 (see the right-hand part in FIG. 2). The pick-up head 9 is shown in FIG. 2 in detail.

The transport mechanism 6 is subsequently controlled so that the pick-up head 9 arrives at a position diametrically opposite the position shown in FIG. 1, that is to say, above a stock station 10 of cutting members 11, which are relatively arranged in a fixed order, that is to say, they are arranged parallel to one another in a row in the embodiment shown.

The conveyor 6 then picks up a cutting member 11 and moves it through an angle of 90° towards the cutting station 12. This cutting station comprises a carrier 13 formed by an apertured plate, which is the top surface of a suction box. The cutting members 11 are disposed one by one in the optimum, desired configuration on the carrier 13, after which the pivotable arm 7 is turned away.

In the meantime the driving mechanism 3 moves the suction wall 2 above the cutting station 12, whilst the belt is turned by means of a motor 14 so that the tobacco leaf sticks to the bottom side of the conveyor belt 2 as a result of the suction effect. After suppression of the suction effect the tobacco leaf is deposited on the arranged cutting members 11 at the cutting station 12. After the return of the conveyor belt 2 by means of the mechanism 3 the cutting rollers 15 are actuated, for example, by a pneumatic ram 16, said rollers being passed along the straight guide 17 along the cutting station 12, whilst the tobacco leaf is pressed across the cutting edges of the cutting members 11.

After the removal of the waste parts of the tobacco leaf, which is not shown in detail in this embodiment, the conveying mechanism 6 picks up one by one the cutting members 11 from the cutting station and conveys them to a suction box 18, the top plate of which is also perforated. The cutting members 11 are then standing in a row one behind the other on the suction box 18, which can be moved up and down in the direction of the arrow P2 and will occupy the lowermost position, when the cutting members 11 are deposited.

Above the suction box 18 is guided a winding belt 19, which is wound on a reel 20 for storing cut tobacco leaf portions. The winding belt 19 is guided by a guide roller 21 joining a suction box 22, which is arranged opposite the suction box 18. The suction box 22 can yield upwards by means of a resilient suspension system 23 in accordance with the increase in size of the winding 20.

Upon the upward movement of the suction box 18 by means of the ram 24 and upon the suppression of the suction effect, the tobacco leaf portions located inside the cutting edges of the cutting members 11 are sucked by the suction box 22 against the winding belt 19, after which upon the start of the motor 25 the belt is wound up over a length equal to the length of the suction box 18.

All mechanical functions of the device are preferably controlled by the same computer 5.

Subsequently the cutting members 11 of the suction box 18 are returned by the conveying mechanism 6 to the stock station 10, where they can be deposited in the same array and where the cutting members can be cleaned.

When the next tobacco leaf is lowered from the stock 1 the mechanical cycle can start again.

FIG. 2 is a sectional view of a detail of the cutting member 11 deposited on the carrier 13, above which is shown the pick-up head 9 of the arm 7.

The cutting member has a cylindrical shape, the basic curve of the cylinder corresponding to the shape of the desired wrapper or binder. The cutting edge 26, therefore, continues downwards in a smooth outer wall so that the lower edge 27 of the cylinder will bear on the apertured top surface of the box-shaped carrier 13. The cutting member 11 itself has a perforated wall 28, which communicates through a channel 29 with the bottom side or the apertures in the upper surface of the carrier 13. The cutting member 11 includes a permanent magnet 30, which ensures that owing to the magnetisable top surface of the box 13 the cutting member 11 is firmly anchored by magnetic forces.

It will be obvious that when a tobacco leaf T is deposited on the cutting member it is firmly retained on the cutting member by the vacuum produced beneath it.

The deposition and the removal respectively of the cutting member 11 are performed by means of the pick-up head 9, which is provided for this purpose with an electro-magnet 31, which upon energization reverses the field of the magnet 30 and of the cutting member 11 so that the cutting member 11 is attracted by the plate 32 of the pick-up head 9. The head is furthermore provided with a step motor 33 or the like by means of which the plate 32 can be turned about the axis 34 with respect to the head 9 so that there can be adjusted an angular position of the cutting member 11 relative to the carrier 13.

As a matter of course the invention is not limited to the embodiments depicted above. The scope of the invention includes any cutting mode in which loose cutting members are employed, which can be arrayed in any pattern.

What is claimed is:

1. The method of cutting a succession of tobacco leafs, each into portions of predetermined shape, which comprises the steps of:

(a) inspecting a succession of leafs to determine the locations of undesirable portions thereof;

(b) repeatedly transferring a plurality of cutting dies back and forth between one station at which they are arranged in a fixed array and a cutting station at which they are arranged in a succession of unique arrays different from said fixed array and in which each unique array is determined by the inspection of step (a) to allow said cutting dies and a leaf to be reigstered so as to avoid said undesirable portions determined in step (a) for that leaf;

(c) transferring said leafs successively to said cutting station and into registry with the corresponding unique array of cutting dies;

(d) cutting said leafs at said cutting station and capturing the cut leaf portions with said dies; and (e) removing said cut leaf portion from said dies and depositing them in predetermined relationship to each other on a web, and winding said web to form a bobbin.

2. The method as defined in claim 1 wherein, prior to step (e), said dies are transferred from said cutting station to said web to form said fixed array thereof, and are thereafter transferred from said web to said one station.

3. The method as defined in claim 1 wherein the transferring of step (b) is stepwise so that both the fixed array and said unique arrays are built up progressively.

4. A machine for cutting a succession of tobacco leafs, each into portions of predetermined shape, comprising in combination:

means for inspecting a succession of leafs to determine and store the locations of undesirable portions thereof;

means for repeatedly transferring a plurality of cutting dies back and forth between one station at which they are arranged in a fixed array and a cutting station at which they are arranged in a succession of unique arrays different from said fixed array and in which each unique array is determined by the information stored by the means first mentioned to allow said cutting dies and a leaf to be registered so as to avoid said undesirable portions determined for that leaf;

means for transferring said leafs successively to said cutting station;

means for causing said cutting dies to cut through said leafs after they are transferred to the cutting station and to capture leaf portions within the dies;

means for removing said cut portions from said dies; and means for forming a bobbin containing said cut portions.

5. A machine as defined in claim 4 wherein means is provided for magnetically retaining each die at said cutting station.

6. A machine as defined in claim 5 wherein a carrier is provided at said cutting station for receiving said cutting dies in said unique arrays thereof.

7. A device as claimed in claim 6 characterized in that the carrier is formed by a suction box, the carrying surface of which has a uniform pattern of uninterrupted apertures, each cutting member having inside the cutting edge a perforated wall, which freely communicates with the carrier.

8. A device as claimed in claim 7 characterized in that the cutting member includes a permanent magnet and the carrying surface of the carrier is made from magnetisable material.

* * * * *